United States Patent [19]

Spitz

[11] Patent Number: 4,814,954

[45] Date of Patent: Mar. 21, 1989

[54] RIGID LIGHTWEIGHT FLUORESCENT FIXTURE

[76] Inventor: Russell W. Spitz, 2999 Hartley Rd., Ste. 301, Bldg. C, Jacksonville, Fla. 33217

[21] Appl. No.: 137,602

[22] Filed: Dec. 24, 1987

[51] Int. Cl.[4] ..... F21S 3/00

[52] U.S. Cl. ..... 362/217; 362/260; 362/349

[58] Field of Search ..... 302/217, 346, 347, 341, 302/260, 433, 457, 147, 148, 150, 349, 257, 296, 297

[56] References Cited

U.S. PATENT DOCUMENTS

| | | | |
|---|---|---|---|
| 2,972,675 | 2/1961 | Schiffer | 362/217 |
| 3,045,577 | 7/1962 | Lazerson | 362/260 |
| 3,125,301 | 3/1964 | Stotter | 362/217 |
| 3,154,001 | 10/1964 | Zurawski | 362/260 |
| 3,159,352 | 12/1964 | Wakefield et al. | 240/51.11 |
| 4,388,675 | 6/1983 | Lewin | 362/225 |
| 4,403,275 | 9/1983 | Oser | 362/225 |
| 4,644,454 | 2/1987 | Herst et al. | 362/260 |
| 4,719,546 | 1/1988 | Spitz | 362/260 |
| 4,729,075 | 3/1988 | Brass | 362/217 |

FOREIGN PATENT DOCUMENTS

| | | | |
|---|---|---|---|
| 0241074 | 10/1987 | European Pat. Off. | 362/260 |
| 2645767 | 4/1978 | Fed. Rep. of Germany | 362/217 |
| 660465 | 11/1961 | United Kingdom | 362/217 |

*Primary Examiner*—Ira S. Lazarus
*Assistant Examiner*—D. M. Cox
*Attorney, Agent, or Firm*—Harpman & Harpman

[57] ABSTRACT

A rigid lightweight fluroescent lighting fixture using a single elongated tubular light source and an elongated lightweight improved reflector construction having multiple elongated strip-like planar mirror surfaces is disclosed. The lightweight reflector construction is positioned between double walled end panels which are in turn connected to one another by a double walled elongated box-like structure formed of two elongated inter-engaging body members. Lamp holders of appropriate configuration are slidably mounted in slotted brackets formed on the double walled end panels so as to support an elongated fluorescent tube. The simply formed inexpensive fixture efficiently positions the improved reflector structure and the fluorescent tube on a suspended ceiling or the like and adds very little weight to the supporting structure.

6 Claims, 2 Drawing Sheets

RIGID LIGHTWEIGHT FLUORESCENT FIXTURE

BACKGROUND OF THE INVENTION

1. Technical Field

This invention relates to fluorescent lighting fixtures of the type utilizing elongated fluorescent tubes in a fixture mounted on the ceiling of an enclosure to be illuminated thereby.

2. Description of the Prior Art

Prior fluorescent lighting apparatus such as used in commercial applications including retail stores and the like have generally utilized two or more fluorescent tubes positioned in side by side relation on or in a fixture formed of several metal stampings, the outer and/or lower surfaces of which have been finished with a white enameled light reflective surface. My copending application of patent entitled "Fluorescent Lighting Apparatus", Ser. No. 06/865,411, now U.S. Pat. No. 4,719,546. illustrates an improved reflector structure which is particularly suitable in the present improved rigid lightweight fluorescent fixture.

Prior art fluorescent lighting fixtures are illustrated in U.S. Pat. Nos. 3,159,352, 4,388,675, and 4,403,275. In each of these disclosures a substantial tube supporting structure is disclosed. In U.S. Pat. No. 3,159,352 the tube supporting structure is formed of a pair of elongated body members and an expensive single piece refractor incorporating upwardly angling side walls and a curved lower light directing surface. There is very little structure that is capable of reflecting light downwardly toward the refractory lens.

U.S. Pat. No. 4,388,675 illustrates a substantial elongated box-like structure in which several elongated fluorescent tubes are disposed, the structure incorporates double walls, one of which has plurality of light reflecting elongated surfaces and the side walls of the structure formed at right angles thereto forming secondary reflectors.

U.S. Pat. No. 4,403,275 also discloses an elongated substantial metal box-like construction defining an elongated rectangular opening having a hinged refractor lens attached thereto. Slightly curved reflectors are positioned at either side of the structure and the side walls include vertical sections and angular sections relative to the flat upper portion of the fixture.

The present invention mounts the improved reflector of my above-mentioned patent application, now U.S. Pat. No. 4,719,546 in a simple efficient rapidly assembled fixture formed of light-weight rigid components to effectively position a single fluorescent tube in my improved reflector by which the rigid lightweight fluorscent fixture of this invention delivers more light into the desired area while utilizing a single fluorescent tube than the multi-tube fluorescent fixtures of the prior art.

SUMMARY OF THE INVENTION

The rigid lightweight fluorescent fixture disclosed herein positions an elongated fluorescent tube in a reflector having a plurality of elongated relatively flat silver light reflecting surfaces arranged in a modified arcuate shape, the reflector being formed of lightweight material such as aluminum and supported by double walled end panels and a double walled box-like longitudinally extending structure positioned therebetween, the reflector being positioned beneath the elongated box-like structure and between the longitudinally spaced double walled end panels and a fluorescent tube positioned in desirable location in the reflector is supported by lamp hangers formed to register in appropriate configurations and openings formed in the double walled end panels. The end panels are also so formed as to directly support the fluorescent tube insuring against its accidental removal therefrom.

DESCRIPTION OF THE PREFERRED EMBODIMENT

Figure 1:
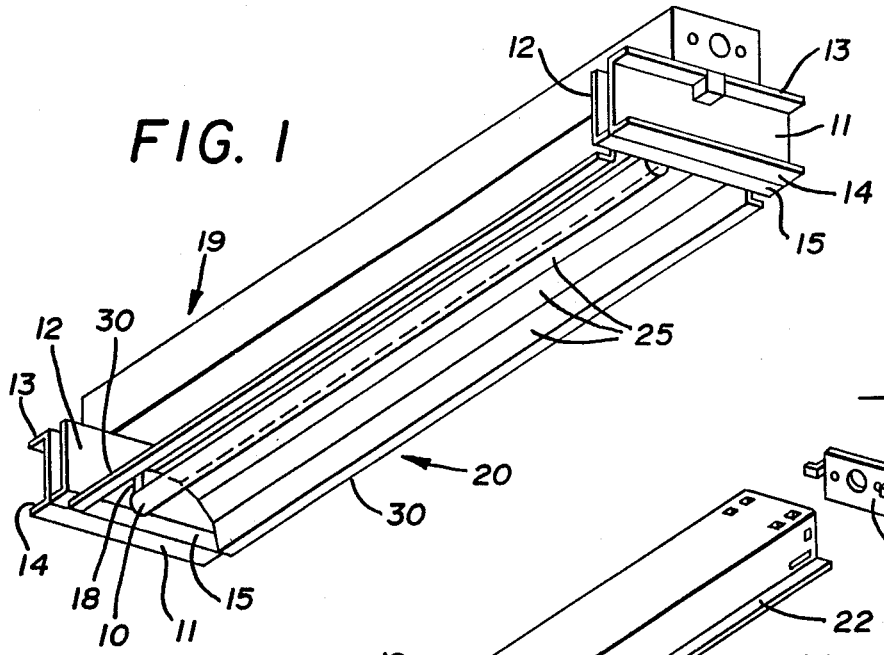
FIG. 1 is a perspective elevation of the fixture.
Figure 2:
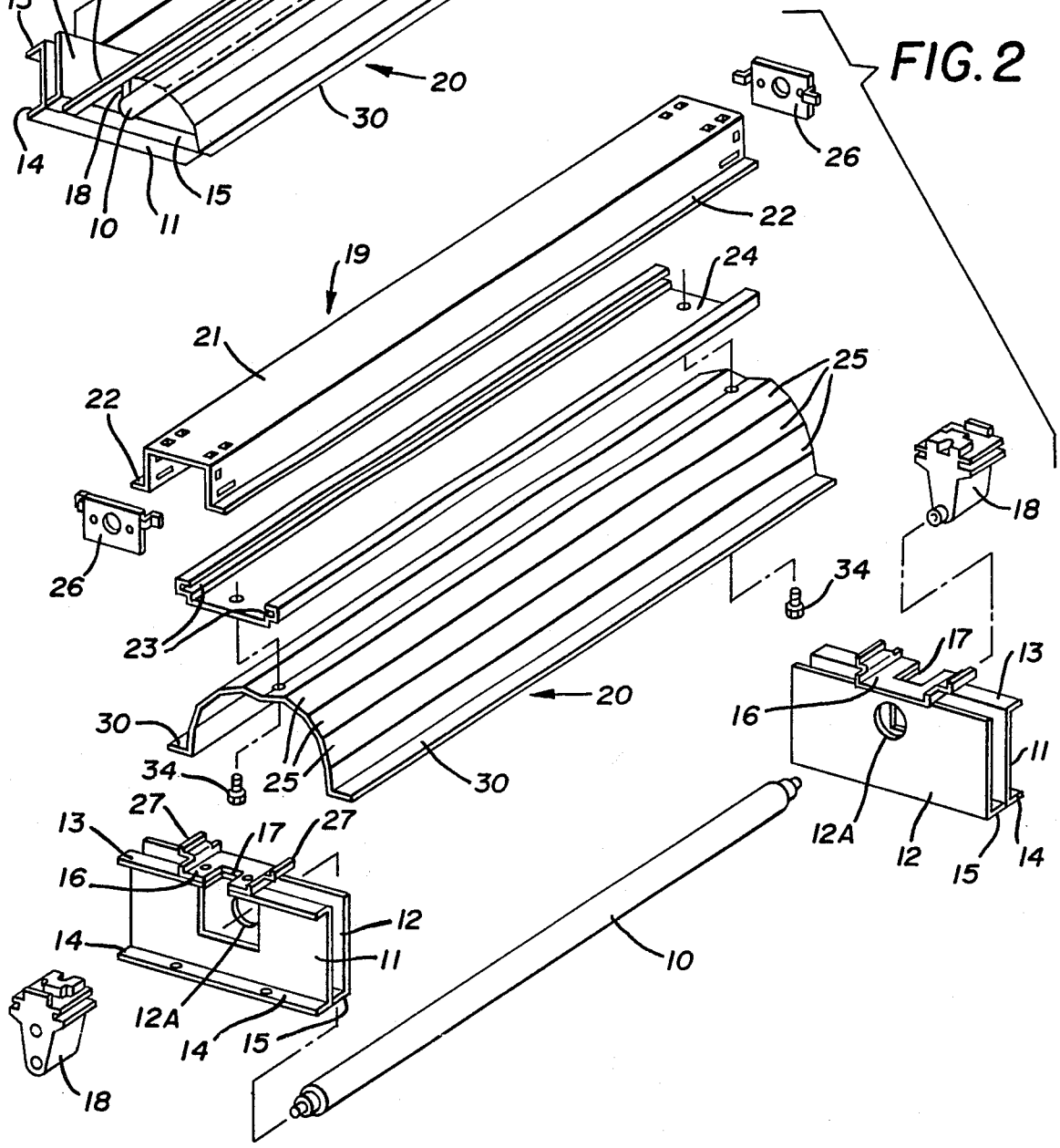
FIG. 2 is an exploded perspective view thereof.
Figure 3:
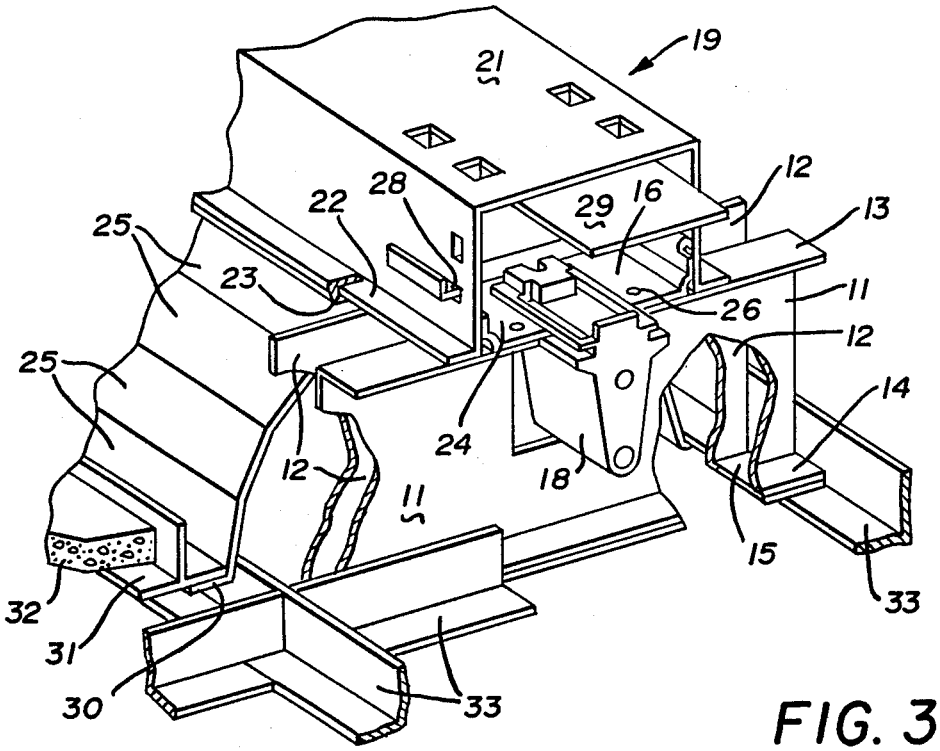
FIG. 3 is an enlarged perspective view of an end thereof.

By referring to the drawings and FIG. 1 in particular, a perspective elevation looking upward at the rigid lightweight fluorescent fixture of the invention may be seen in which a fluorescent tube 10 is positioned. In FIG. 1 of the drawings, a pair of longitudinally spaced double walled end panels will be seen to each comprise outer end walls 11 and inner end walls 12, the outer end walls 11 having outturned upper and lower flanges 13 and 14 and the inner end walls 12 having outturned flanges 15. The outer and inner end wall panels 11 and 12 are joined to one another by brackets 16 as best seen in FIGS. 2 and 3 of the drawings. It being observed that the outturned flanges 13 and the brackets 16 have registering notches 17 formed therein which slidably receive and position lamp hangers 18. It will be observed that the inner end panels 11 are each apertured as at 9 so that the end portions of the fluorescent tube 10 can be positioned therethrough so as to support the fluorescent tube directly while its contacts on its end electrically engage contacts in the light hangers 18 as will be understood by those skilled in the art.

Referring again to FIG. 1 of the drawings, it will be seen that an elongated box-like structure 19 is positioned on the upper portions of the double walled end panels 11 and 12 and that an improved longitudinally extending reflector structure 20 is positioned between the inner walls 12 of the double walled end panels and immediately below the elongated box-like structure 19.

By referring to FIG. 2 of the drawings, it will be seen that the elongated box-like structure 19 is formed of an elongated inverted channel-shaped member 21 provided with outturned longitudinally extending flanges 22 on its edges. The outturned flanges 22 are positioned for continuous engagement in longitudinally extending channels 23 formed in oppositely disposed relation on the opposite longitudinal edges of a body member 24 which in the assembly of the rigid lightweight fluorescent fixture is positioned directly on the reflector structure 20.

Still referring to FIG. 2 of the drawings, it will be seen that the reflector structure 20 is of a modified arcuate shape having a plurality of longitudinally extending transversely flat light reflective portions 25 positioned radially of the fluorescent tube 10 so as to partially surround the same. The reflector structure 20 and its light reflective portions 25 are representative of the invention of my copending patent application Ser. No. 06/865,411, now U.S. Pat. No. 4,719,546.

The several light reflective portions 25 are arranged in edge to edge relation and comprise silver light reflecting material such as a silver carrying film affixed thereto and/or the reflector structure 20 may be formed of highly specular aluminum with the capability of reflecting at least 87% of the light directed thereto by the fluorescent tube 10 while the silver foil film such as known in the art reflects at least 95% of the light directed thereto.

Still referring to FIG. 2 of the drawings, it will be seen that end closures 26 are provided with extending tabs by which they may be engaged in openings in the inverted channel shaped member 21.

An enlarged end portion of the rigid lightweight fluorescent fixture of the present invention may be seen in FIG. 3 of the drawings and by referring thereto the assembled relation of the several parts may be seen as well as the positioning of a fixture so formed in a recessed opening in a suspended ceiling or the like. In FIG. 3 of the drawings, the elongated box-like structure 19 of the fixture comprising the inverted channel shaped member 21 and the body member 24 are illustrated extending over the upper edge of the end wall panel 12 and the right angular flange 13 on the end wall panel 11. The bracket 16 is illustrated as being attached to the outturned flange 13 of the end wall panel 11 by fasteners 26 positioned on either side of the lamp hanger 18 which is illustrated in position in the notches 17 in the flange 13 and bracket 16 as hereinbefore described. The bracket 16 is provided with oppositely disposed tabs 27, the outer ends of which are elevated and engaged in slots 28 in the side walls of the inverted channel shaped member 21 and the longitudinal flanges 22 on the inverted channel shaped member 21 are illustrated as engaged in the channels 23 defined along the edges of the body member 24 so as to form double walls on the rigid structure 19.

In FIG. 3 of the drawings, a connector plate 29 is slidably mounted partially within the inverted channel shaped member 21 and held by downturned and inturned tabs formed therein so that it can extend into a similar configuration in an adjacent fixture. The reflector structure 20 is provided with longitudinally extending outturned flanges 30 on its longitudinal edges and in FIG. 3 of the drawings these are illustrated as being positioned beneath inverted T-shaped frames 31 which support suspended ceiling panels 32, the longitudinal flanges 30 and the T-shaped frames 31 being positioned on a frame 33 which defines a rectangular opening in which the bottom of the reflector structure 20 registers. The arrangement is such that the lightweight reflector structure is held in properly aligned position by the engagement of the flanges 30 thereon between the frame structure 33 and the inverted T-shaped frames 31.

It will occur to those skilled in the art that a refractor lens may be provided with edge configurations for snap-on registry with the outturned flanges 30 of the reflector structure when the fixture is mounted below a suspended ceiling as illustrated in FIG. 1 of the drawings or alternately on the structure supporting the fixture when it is in recessed position in an opening in a suspended ceiling or the like as illustrated in FIG. 3 of the drawings.

By referring again to FIG. 2 of the drawings, it will be seen that the reflector structure 20 is secured by fasteners 34 positioned upwardly through the uppermost portion of the reflector structure 20 and engaging apertures in the body member 24. It will thus be seen that the rigid lightweight fluorescent fixture disclosed herein is formed of a relatively few inexpensive stamped metal parts or molded synthetic resin as desired and that it will efficiently and safely hold an elongated fluorescent tube safely and position it in a lightweight preferably silver multiple planar reflector positioned radially thereabout with the reflector being structurally and protectively positioned between the double paneled end sections and the elongated box-like supporting structure extending longitudinally along the upper outtermost surface of the reflector.

Those skilled in the art will observe that the necessary ballasts may be positioned in the box-like structure which additionally forms raceways for the current conductors extending to a power source and to the lamp holders which engage the fluorescent tube in the fixture.

Having thus described my invention, what I claim is:

1. In fluorescent lighting fixture of the type having one fluorescent tube and elongated structures supporting the same, an improved rigid lightweight fluorescent fixture, the improved fixture comprising an elongated light reflector of a modified transversely arcuate shape positioned radially of and partially surrounding a fluorescent tube and defining an elongated downward facing opening of a known width, end panels positioned at the ends of said elongated reflector and an elongated flat body member engaging said end panels and extending therebetween above said ligth reflector, longitudinally extending configurations on the opposite sides of said elongated flat body member and an inverted channel shaped elongated body member having configurations on the longitudinal edges thereof engaged in said longitudinally extending configurations on said elongated flat body member so as to form a hollow rigid structure, brackets on said end panels engaging openings in said rigid structure and means securing said elongated light reflector to said rigid structure, openings in each of said end panels and lamp hangers registering in said openings so as to be supported thereby.

2. The improved rigid lightweight fluorescent fixture set forth in claim 1 and wherein said elongated light reflector is formed with a plurality of elongated transversely flat panels and elongated silver reflector means is positioned on said elongated light reflector.

3. The improved rigid lightweight fluorscent fixture set forth in claim 1 and wherein said elongated light reflector has a plurality of elongated planar surfaces arranged to reflect light from said fluorescent tube in a direction away from said fluorescent tube and outwardly and downwardly through said downward facing opening.

4. The improved rigid lightweight fluorescent fixture set forth in claim 1 and wherein said end panels comprise a pair of rectangular members spaced with respect to one another, right angular flanges on some of the longitudinal edges of said panels and brackets secured to said panels, oppositely disposed outturned tabs on said brackets for engaging oppositely disposed openings in said interval channel shaped body member and lamp hangers having front, back and side surfaces, oppositely disposed configurations on said side surfaces for registry in openings in said end panels and notches in one of said panels and said bracket arranged to hold said lamp hangers in fixed position in said end panels and secondary openings in said panels through which said fluorescent tube registers so as to be supported by said end panels when engaged in said lamp hangers.

5. The improved right lightweight fluorescent fixture set forth in claim 1 and wherein said elongated light reflector is formed of highly specular aluminum.

6. The improved rigid lightweight fluorescent fixture set forth in claim 1 and wherein said elongated light reflector is formed with a plurality of elongated transversely flat panels defining said modified transversely arcuate shape and silver foil affixed to said elongated transversely flat panels to form planar mirrors arranged to reflect light from said fluorescent tube in a direction away from said fluorescent tube and outwardly and downwardly through said downwardly facing opening.

* * * * *